US007878369B2

(12) United States Patent
Kobayashi et al.

(10) Patent No.: US 7,878,369 B2
(45) **Date of Patent: *Feb. 1, 2011**

(54) MEDICINE FEEDING APPARATUS

(75) Inventors: Koichi Kobayashi, Ota (JP); Takashi Mori, Ota (JP); Hideyuki Takahashi, Ota (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 128 days.

This patent is subject to a terminal disclaimer.

(21) Appl. No.: 10/984,832

(22) Filed: Nov. 10, 2004

(65) Prior Publication Data

US 2005/0122010 A1 Jun. 9, 2005

(30) Foreign Application Priority Data

Dec. 1, 2003 (JP) ..... 2003-401211

(51) Int. Cl.
*B65H 1/00* (2006.01)

(52) U.S. Cl. ..... 221/197; 221/287; 221/90; 221/199; 312/209

(58) Field of Classification Search ..... 221/69, 221/89–91, 197, 199, 287; 312/1–352
See application file for complete search history.

(56) References Cited

U.S. PATENT DOCUMENTS 4,902,080 A * 2/1990 Berger ..... 312/348.4
5,417,329 A * 5/1995 Whitman ..... 206/499
5,460,294 A * 10/1995 Williams ..... 221/2
5,787,678 A * 8/1998 Koike et al. ..... 53/154
5,895,103 A * 4/1999 Huber ..... 312/348.4
5,961,036 A * 10/1999 Michael et al. ..... 232/43.1
6,011,999 A * 1/2000 Holmes ..... 700/231
6,012,602 A * 1/2000 Yuyama et al. ..... 221/130
6,349,999 B1 * 2/2002 Takahashi et al. ..... 312/209
6,585,132 B2 * 7/2003 Kim ..... 221/133
6,604,019 B2 * 8/2003 Ahlin et al. ..... 700/231
6,733,095 B1 * 5/2004 Rieb ..... 312/122
6,966,452 B2 * 11/2005 Kim ..... 221/133
7,040,070 B2 * 5/2006 Yuyama et al. ..... 53/154
7,134,242 B2 * 11/2006 Fitzgerald ..... 49/125
2005/0145644 A1 * 7/2005 Mori et al. ..... 221/242
2006/0230710 A1 * 10/2006 Ishiwatari et al. ..... 53/493

FOREIGN PATENT DOCUMENTS

JP 57-5282 2/1982
JP 2003-237702 8/2003

* cited by examiner

*Primary Examiner*—Gene Crawford
*Assistant Examiner*—Michael K Collins
(74) *Attorney, Agent, or Firm*—Edwards Angell Palmer & Dodge LLP

(57) ABSTRACT

A medicine feeding apparatus in which a usability is improved by automatically executing a fine adjustment of a horizontal position and a vertical position of a door panel in correspondence to an operation of taking a drawer in and out without the necessity of executing a troublesome mount fine adjusting work of a door panel. In a medicine feeding apparatus provided with a main body, drawers are attached to the main body so as to be freely drawn, a plurality of tablet cases are detachably attached to the drawers and receiving medicines, and a door panel of the drawer is rotatably held and is finely adjusted to a proper position in correspondence to an operation of taking the drawer in and out.

12 Claims, 4 Drawing Sheets

MEDICINE FEEDING APPARATUS

BACKGROUND OF THE INVENTION

Field Of The Invention

The present invention relates to a medicine feeding apparatus which feeds a medicine received in a tablet case to a package bag in accordance with a kind of medicine and a quantity designated by a prescription, in a hospital, an ethical pharmacy or the like, and more particularly to a medicine feeding apparatus provided with drawers which are attached to a main body so as to be freely drawn, and a plurality of tablet cases which are detachably attached to the drawers and receive the medicine.

In the conventional art, in the hospital and the ethical pharmacy, for example, as shown in Japanese Utility Model Publication No. 57-5282, the medicine prescribed by a doctor is supplied to a patient by using a medicine feeding apparatus (referred to as a "tablet packaging machine" in this document). In this system, all the works from an extracting work to a packaging work are automated and include the steps of discharging the medicine (a tablet, a capsule agent or the like) in accordance with the kind and the quantity described in the prescription from a discharge drum (called as an aligning table in the document mentioned above) within a tablet case one by one, collecting by a hopper via a chute, and thereafter packaging by a packing paper.

On the other hand, as shown in Japanese Unexamined Patent Publication No. 2003-237702, there is a structure in which the tablet case is attached so as to be freely drawn from the main body of the medicine feeding apparatus and be detachable, in order to make it easy to extremely easily execute a maintenance work such as a cleaning work, a replacing work and the like of the tablet case.

In this case, in the medicine feeding apparatus as shown in the former document, the tablet case, the chute, the hopper and the like are contaminated by micro powders or the like generated from the medicine in correspondence to an impact caused by the medicine drop, and there is a case that the micro powders are erroneously enclosed in the packing paper. However, in the conventional medicine feeding apparatus, because the structure is made such that particularly the hopper, a loading apparatus and the like are fixed within the main body, it is extremely difficult to execute maintenance such as cleaning, the parts replacement and the like.

On the other hand, in the medicine feeding apparatus as shown in the latter document, a plurality of tablet cases receiving the medicines are provided in parallel to the freely drawn shelf, however, because a door panel having a function serving as a door attached to a front surface of the shelf is fixed firmly by a screw or the like, a positional relation between the door panels is displaced in a normal state in which a plurality of drawers are compressed, if the door panel is attached to a position displaced from a proper position by fastening the screw, so that there is generated a problem that an appearance from the front surface is deteriorated in the medicine feeding apparatus, and it is necessary to again execute an attachment fine adjusting work for repairing the positional relation.

SUMMARY OF THE INVENTION

An object of the present invention is to provide a medicine feeding apparatus in which usability is improved by automatically executing a fine adjustment of a horizontal position and a vertical position of a door panel in correspondence to an operation of taking a drawer in and out without the necessity of executing a troublesome mount fine adjusting work of a door panel. Further, in addition, an object of the present invention is to provide a medicine feeding apparatus in which a circuit board receiving a signal from a tablet case received in each of the drawers is arranged in a back side of a door panel, and the circuit board is separated in each of the drawers.

In other words, in accordance with the present invention, there is provided a medicine feeding apparatus (1) comprising:

a main body (2);

drawers (5) attached to the main body so as to be freely drawn; and a plurality of tablet cases (6) detachably attached to the drawers and receiving medicines, wherein a door panel (11) of the drawer (5) is rotatably held and is finely adjusted to a proper position in correspondence to an operation of taking the drawer in and out.

Further, in accordance with the present invention, the drawer (5) of the medicine feeding apparatus (1) is constituted by a drawer main body (15) detachably attaching a plurality of tablet cases (6), and a door panel (11) rotatably held to a front surface (16) of the drawer main body, and a circuit substrate (17) is arranged between the drawer main body (15) and the door panel (11).

Further, in accordance with the present invention, the drawer (5) of the medicine feeding apparatus (1) is structured such that the door panel (11) is rotatably held to the front surface (16) of the drawer main body (15) via a mounting plate (18).

Further, in accordance with the present invention, the mounting plate (18) of the medicine feeding apparatus (1) is rotatably held to the front surface (16) of the drawer main body (15) by a screw (23) and a spacer (24).

Further, in accordance with the present invention, a thickness (T1) of the spacer (24) in the medicine feeding apparatus (1) is larger than a thickness (T2) of the mounting plate (18).

Further, in accordance with the present invention, the spacer (24) in the medicine feeding apparatus (1) is structured by a metal.

Further, in accordance with the present invention, the mounting plate (18) in the medicine feeding apparatus (1) is constituted by a panel mounting body (21) fixing the door panel (11), and a substrate mounting body (22) fixing the circuit board (17).

Further, in accordance with the present invention, the panel mounting body (21) in the medicine feeding apparatus (1) is provided with a cut-off hole (27) having an inner diameter R2 which is smaller than an outer diameter R1 of a head portion of a screw (23) and larger than an outer diameter of the spacer, and a difference in dimension between the inner diameter R2 of the cut-off hole (27) and the outer diameter of the spacer is larger than a difference in dimension (T1−T2) between a thickness (T1) of the spacer and a thickness (T2) of the mounting plate.

Further, in accordance with the present invention, an outer periphery of the door panel (11) in the medicine feeding apparatus (1) is provided with protruding portions for fine adjustment (32, 33) opposing to the adjacent door panel.

Further, in accordance with the present invention, the protruding portion (32) in the medicine feeding apparatus (1) is formed at two right and left positions on an upper surface of the door panel (11), and has a proper height which is equal to an interval (3*a*) with respect to the upper and lower adjacent door panel.

Further, in accordance with the present invention, the protruding portion (33) in the medicine feeding apparatus (1) is provided at the center of both right and left side surfaces of the door panel (11), and has a proper height (2*a*) which is equal to an interval (4*a*) with respect to the right and left adjacent door panel.

Further, in accordance with the present invention, the medicine feeding apparatus (1) is structured such that the door panel (11) attached to the panel mounting body (21) and the circuit board (17) attached to the substrate mounting body (22) are integrally rotated in correspondence to the operation of taking the drawer (5) in and out.

Further, in accordance with the present invention, there is provided a medicine feeding apparatus (1) comprising:

a main body (2);

a plurality of tablet cases (6) receiving medicines; and drawers (5) attached to the main body so as to be freely drawn, and detachably attaching the tablet cases, wherein the drawer (5) is constituted by a drawer main body (15) detachably attaching a plurality of tablet cases, and a door panel (11) rotatably held to a front surface of the drawer main body, a circuit board (17) is arranged between the drawer main body and the door panel, the door panel is rotatably held to the drawer main body (15) and is finely adjusted to a proper position in correspondence to an operation of taking the drawer (5) in and out, the medicine discharged from the tablet case (6) is free fallen so as to be collected at one position, and the collected medicine is charged into a medicine packing paper.

Further, in accordance with the present invention, the drawer (5) in the medicine feeding apparatus (1) rotatably holds the door panel (11) to a front surface (16) of the drawer main body via a mounting plate (18), and the mounting plate (18) is rotatably held to the drawer main body (15) by a screw (23) and a spacer (24).

DETAILED DESCRIPTION OF THE PREFERRED EMBODIMENT

A description will be given in detail below of an embodiment in accordance with the present invention with reference to the accompanying drawings.

Figure 1:
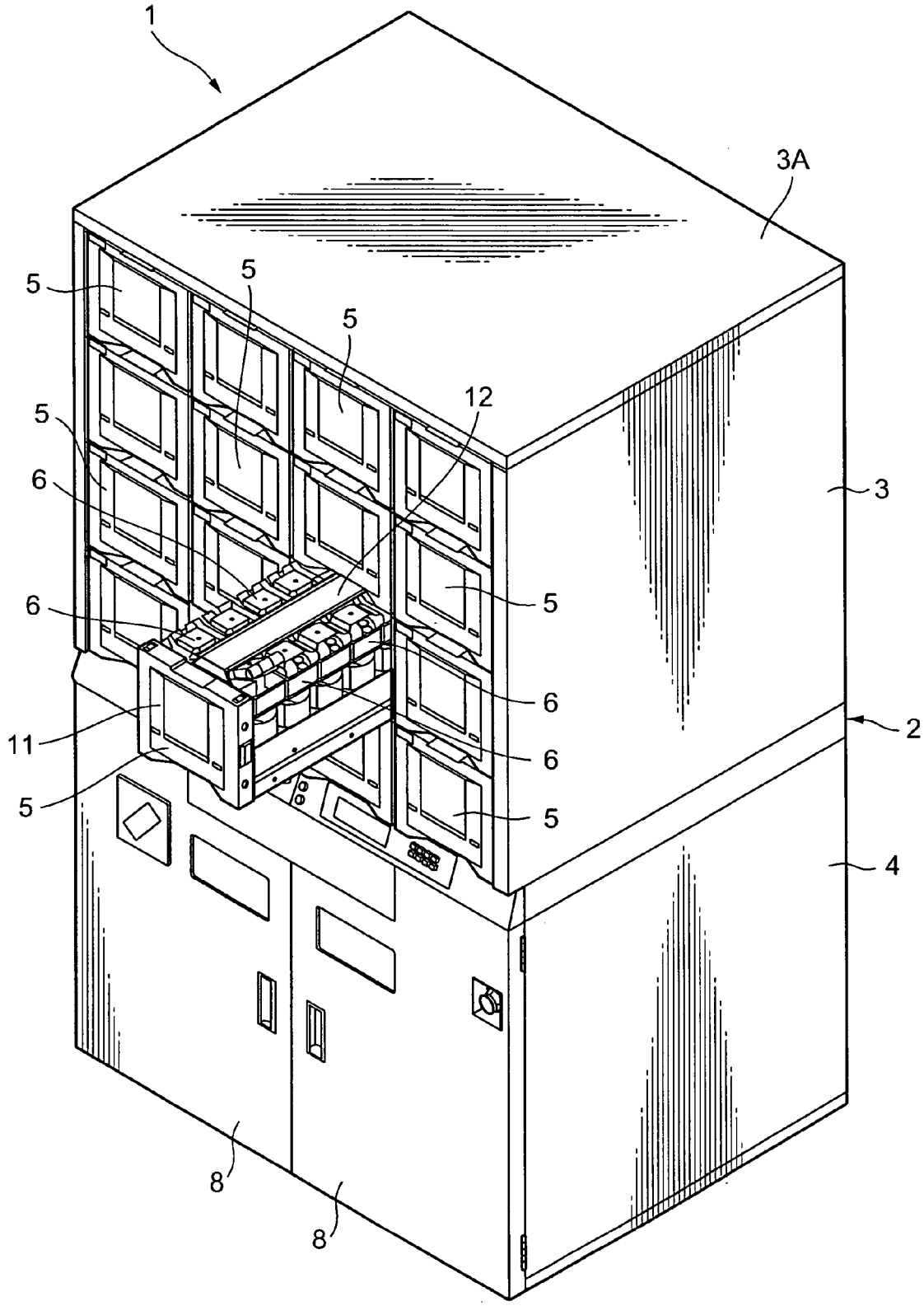
FIG. 1 is a perspective view of a state in which a certain drawer is drawn out in a medicine feeding apparatus in accordance with the present invention.

A medicine feeding apparatus 1 in accordance with the present invention is installed in a hospital, an ethical pharmacy or the like, and carries out all the works from an extracting work of the medicine to a packing work of the medicine comprising the steps of discharging the medicine (the tablets, the capsule agent and the like) from a discharge port within a tablet case one-by-one in accordance with the kind and the quantity described in the prescription, collecting the medicine by a hopper via a chute serving as a free-fall passage by utilizing a weight of the medicine to one position, and thereafter packaging the medicine by a packing paper, in a series of mechanisms, whereby all the steps are automated. As shown in FIG. 1, the medicine feeding apparatus 1 is constituted by a main body 2 having a vertically longer rectangular shape, and is controlled by a personal computer (not shown).

The main body 2 is constituted by an upper structure body 3 and a lower structure body 4 which can be separated from each other, and is structured such that the upper structure body 3 is laminated on the lower structure body 4 so as to be connected thereto. Further, a case receiving portion in which a front side and upper and lower sides are open is structured within the upper structure body 3 for receiving a tablet case 6 mentioned below, and a top surface of the case receiving portion is closed by a detachable top plate 3A.

Shelves 5, . . . serving as drawers are provided at four lateral rows and five vertical stages (in conformity to twenty) within the case receiving portion of the upper structure body 3 so as to be freely drawn. A door panel 11 is attached to a front end of each of the shelves 5, and the respective door panels 11 close a front opening of the upper structure body 3 in a state in which all the shelves 5, . . . are received within the case receiving portion. A passage 12 open to upper and lower sides is formed in a center of the shelf 5 so as to extend longitudinally, and forms a passage through which the medicine discharged from the tablet case 6 of the shelf 5 positioned above the shelf drops down. Drive bases 13 of the tablet case 6 are attached to both right and left sides of the passage 12 longitudinally at eight positions (totally sixteen positions in the right and left sides) in parallel in a longitudinal direction (all of them is not illustrated). In this case, the tablet case 6 is constituted by the drive base 13 and a receiving container connected to the above thereof.

Further, the lower structure body is open in a front surface and an upper surface, and is communicated with the upper structure 3 in the upper surface. Further, a packing machine (not shown) serving as a filling apparatus mentioned below is received and placed within the lower structure body 4, and a front opening thereof is closed by double lower panels 8 and 8 so as to be freely opened and closed.

Figure 2:
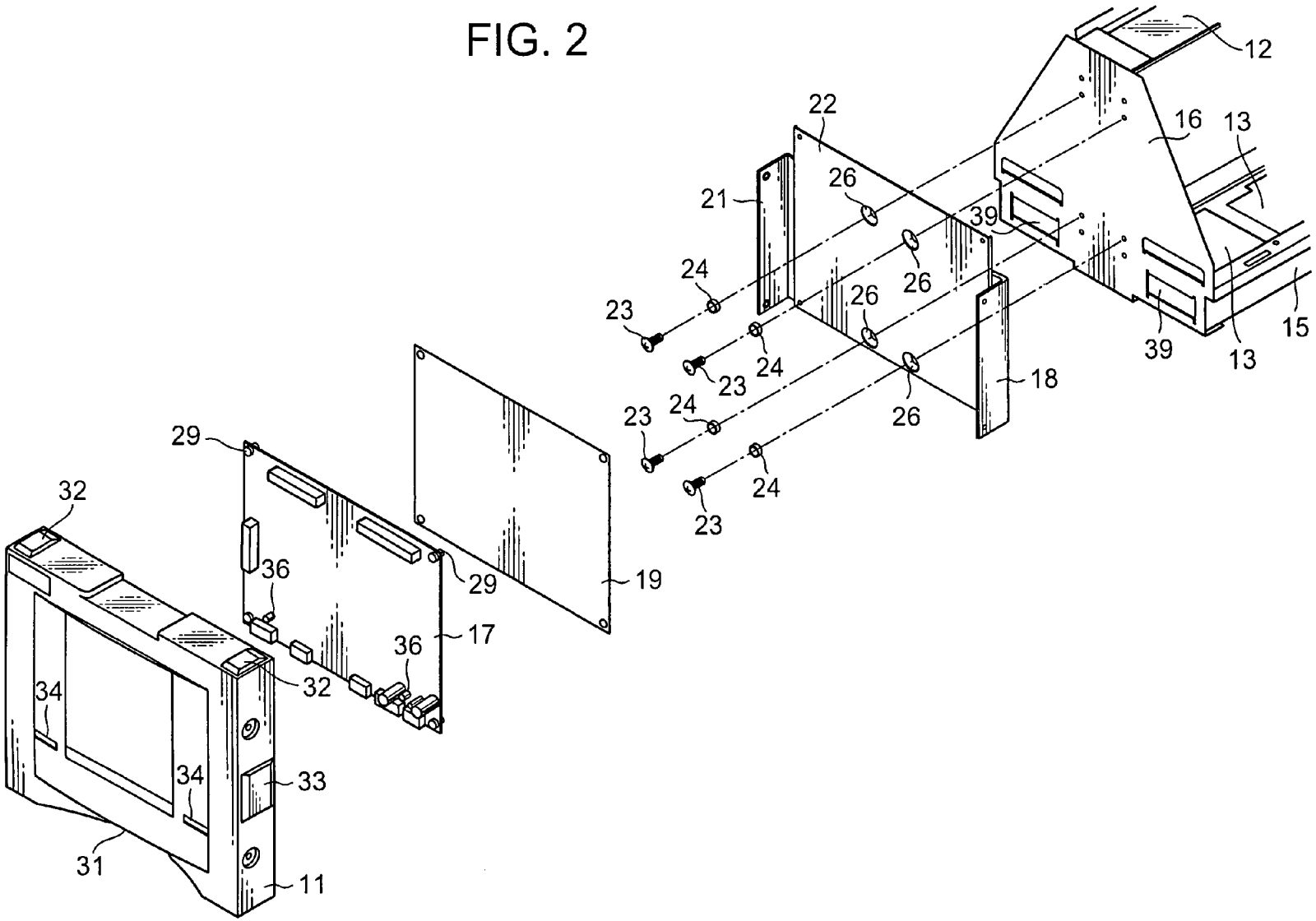
FIG. 2 is a perspective view of a disassembled state in a front portion of the drawer of the medicine feeding apparatus in accordance with the present invention.
Figure 3:
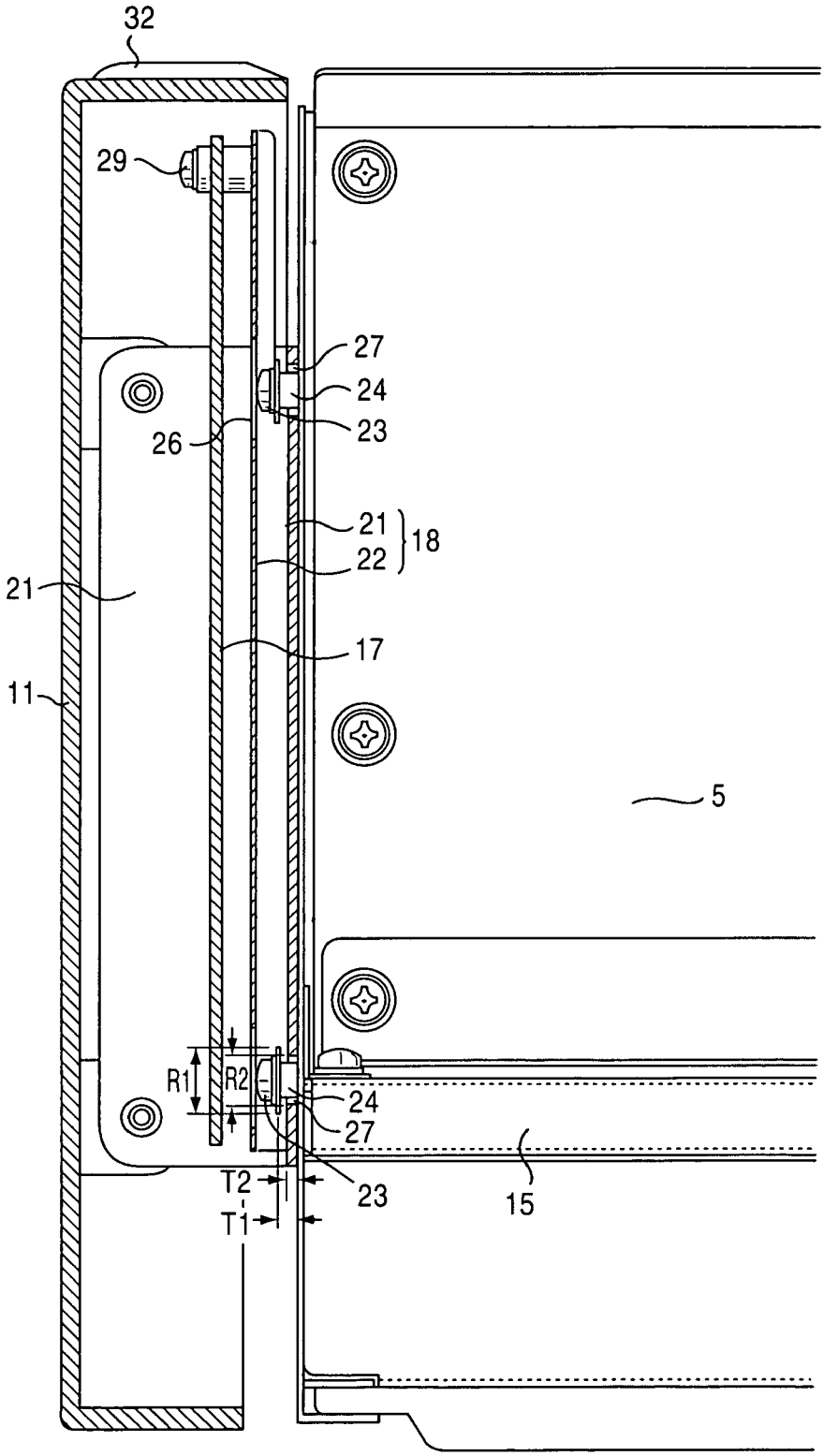
FIG. 3 is a cross sectional view of a front portion of the drawer in the medicine feeding apparatus in accordance with the present invention.
Figure 4:
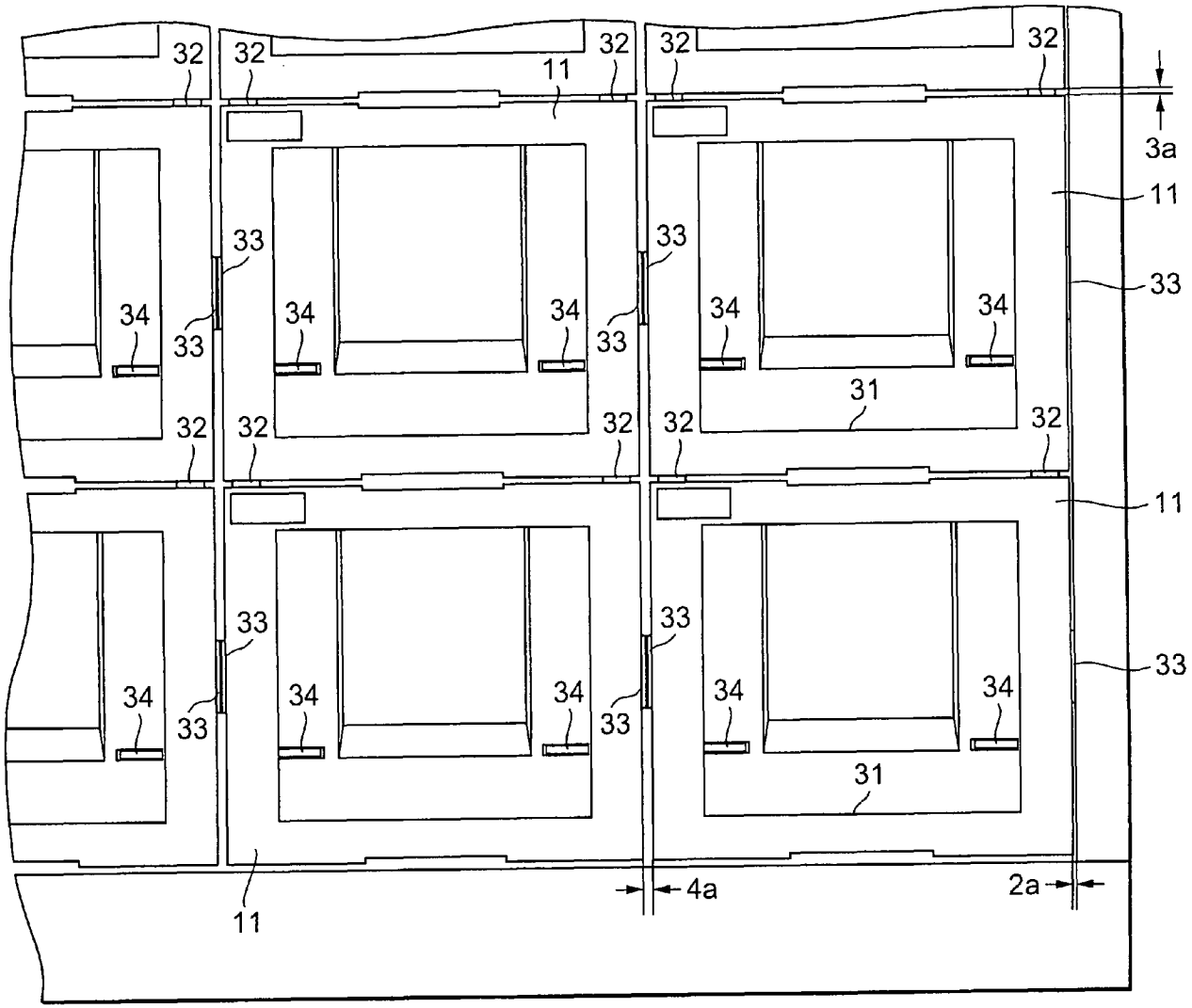
FIG. 4 is a front elevational view explaining a positional relation of upper, lower, right and left sides of the door panel in the medicine feeding apparatus in accordance with the present invention.

Next, a description will be given of a structure of the front portion of each of the shelves 5, that is, a structure in which the door panel 11 of the drawer (the shelf 5) is rotatably held and the door panel 11 is finely adjusted to a proper position in correspondence to the operation of taking the shelf 5 in and out, with reference to FIGS. 2 and 3. A description will be first given of a mounting structure of the door panel, and a description will be subsequently given of a fine adjusting means provided in the door panel 11.

Each of the shelves 5 is constituted by a drawer main body 15 detachably attaching a plurality of (sixteen in this case) tablet cases 6, and the door panel 11 rotatably held to a front plate 16 of the drawer main body 15, and a circuit board 17 is arranged between the front plate 16 of the drawer main body and the door panel 11. The door panel 11 is rotatably held to the front plate 16 of the drawer main body 15 via a mounting plate 18. The circuit board 17 is attached in an insulating manner to the mounting plate 18 via a resin insulating sheet 19. The mounting plate 18 is constituted by a metal panel mounting body 21 fixing the door panel 11, and a metal substrate mounting body 22 fixing the circuit board 17.

The mounting plate 18 is rotatably held to the front plate 16 of the drawer main body 15 by a screw 23 and a metal spacer 24. A thickness T1 of the spacer 24 is made larger than a thickness T2 of the mounting plate 18 (the substrate mounting plate 21 in detail). In the present embodiment, the thickness T2 of the substrate mounting plate 21 is set to 1.5 mm, and the thickness T1 of the spacer is set to 2.5 mm, whereby a difference in dimension (T1-T2) is secured to 0.9 mm. Further, because the difference in dimension is achieved by structuring the spacer 24 by the metal in place of the resin, it is possible to inhibit the spacer from being deformed on the basis of a rigidity of the metal, even if the spacer is fastened over the difference in dimension at a time of fastening the screw 23, and even if the deformation is generated, the deformation can be absorbed by the difference in dimension. In the present embodiment, the screw 23 and the spacer 24 are both attached at four positions.

The panel mounting body 21 is provided with a cut-off hole 27 having an inner diameter R2 which is smaller than an outer diameter R1 of a head portion of the screw 23 and larger than an outer diameter of the spacer, and a difference in dimension between the inner diameter R2 of the cut-off hole 27 and the outer diameter of the spacer is larger than the difference in dimension (T1-T2) between the thickness T1 of the spacer and the thickness T2 of the mounting plate 18. In this case, the inner diameter R2 of the cut-off hole 27 is set to 8 mm, the outer diameter of the spacer 23 is set to 5.5 mm, and the difference in dimension is set to 2.5 mm, and is set to be larger than the difference in dimension (T1-T2=0.9 mm) mentioned above. Because the difference in dimension is secured, the door panel 11 can be rotatably held to the drawer 5 (the drawer main body 15 in detail). Reference numeral 26 denotes a hole for removing the screw 23 formed in the panel mounting plate 21. An inner diameter thereof becomes larger than the outer diameter R1 of the screw 23. Reference numeral 29 denotes a screw for fixing the circuit board 17 to the substrate mounting plate 22.

Next, a description will be provided of the fine adjusting means provided in the door panel side 11. The fine adjusting means is constituted by protruding portions 32 and 33 for fine adjustment opposing to the adjacent door panel provided in the outer periphery of the door panel 11. The protruding portion 32 is formed at two right and left positions on the upper surface of the door panel 11, and is set to have a proper height 3*a* which is equal to an interval 3*a* with respect to the vertically adjacent door panel. The protruding portion 33 is formed at the center of both the right and left side surfaces of the door panel 11, and is set to have a proper height 2*a* which is equal to a half of an interval 4*a* with respect to the laterally adjacent door panel.

Reference numeral 31 denotes a handle formed in a lower portion of the door panel 11 by utilizing concavity and convexity, and reference numeral 34 denotes a display transparent portion provided at a position corresponding to an LED (a display means) 36 for displaying information concerning the tablet case provided in the circuit board 17. Reference numeral 39 denotes a wiring hole provided in the front plate 16 of the drawer main body 15 for passing a signal line (not shown) from eight tablet cases 6 therethrough. Each of the signal lines is connected to a connection portion provided in the mounting substrate 17. In accordance with the structures mentioned above, because it is possible to receive the signal from the tablet case 6 by each of the circuit boards 17 arranged so as to be separated into the respective drawers 5, it is possible to construct the circuit which is independent in each of the drawers 5.

In accordance with the drawer (that is, the shelf) 5 in the first embodiment of the present invention, because the door panel 11 is rotatably held by the spacer 24, the holding structure can be simplified. Because the thickness T1 of the spacer 24 is larger than the thickness T2 of the mounting plate (the panel mounting body in detail) 21, it is possible to absorb the excessively fastened distance on the basis of the difference in dimension, even if the screw 23 is excessively fastened over the proper fastened position. Further, because the spacer 24 is made of metal, it is possible to inhibit and prevent the door panel 11 or the spacer 24 from being broken as a result of the fastening force, even if the screw 23 is excessively fastened over the proper fastened position.

Because the mounting plate 18 is constituted by the panel mounting body 21 fixing the door panel 11, and the substrate mounting body 22 fixing the circuit board 17, it is possible to get a leg of each of the fixing screws 23 and 29 out by utilizing the gap formed between both the mounting bodies 21 and 22. Further, the panel mounting body 21 is provided with the cut-off hole 27 having the inner diameter R2 which is smaller than the outer diameter R1 of the head portion of the screw and larger than the outer diameter of the spacer, and the difference in dimension between the inner diameter R2 of the cut-off hole and the outer diameter of the spacer is larger than the difference in dimension (T1-T2) between the thickness of the spacer and the thickness of the mounting plate, it is possible to rotatably hold the door panel 11 to the drawer 5 by utilizing the difference in dimensions.

Because the outer periphery of the door panel 11 is provided with the protruding portions 32 and 33 for fine adjustment opposing to the adjacent door panel, the protruding portions 32 and 33 are respectively brought into contact with the adjacent surfaces of the adjacent door panels 11 every time when the drawer 5 is taken in and out, whereby the rotatable door panel 11 is freely rotated, it is possible to appropriately adjust the gap of the vertically or laterally adjacent door panels to the fixed intervals 3*a* and 4*a* automatically, and it is possible to finely adjust the door panel 11.

Described in detail, the protruding portion 32 is formed at two right and left positions on the upper surface of the door panel 11, and is set to the proper dimension 3*a* which is equal to the interval 3*a* with respect to the vertically adjacent door panels, whereby the protruding portion 32 is brought into contact with the adjacent surfaces of the vertically adjacent door panels 11 every time when the drawer 5 is taken in and out, so that the rotatable door panel 11 is freely rotated, and it is possible to automatically adjust the gap 3*a* of both the door panels to the fixed interval 3*a*.

On the other hand, the protruding portion 33 is provided at the center of both the right and left side surfaces of the door panel 11, and is set to the proper dimension 2*a* which is equal to a half of the interval 4*a* with respect to the laterally adjacent door panels, whereby the protruding portion 33 is brought into contact with the adjacent surfaces of the laterally adjacent door panels 11 every time when the drawer 5 is taken in and out, so that the rotatable door panel 11 is freely rotated, and it is possible to automatically adjust the gap 4*a* of both the door panels to the fixed interval 4*a*.

Because the fine adjusting work of the door panel 11 to the proper position can be executed every time when the drawer 5 is taken in and out, it is possible to lighten the fastening force and the fixing force between the drawer and the door panel. Because the door panel 11 is rotatably held by the mounting plate 18, it is possible to execute the fine adjustment of the door panel 11 on the basis of the operation of taking the drawer 5 in and out. Because the door panel 11 attached to the panel mounting body 21, and the circuit board 17 attached to the substrate mounting body 22 are integrally rotated in correspondence to the operation of taking the drawer 5 in and out, it is possible to always keep a proper positional relation between the substrate 17 and the panel 11.

As described in detail above, in accordance with the present invention, because it is possible to execute the fine adjusting work of the door panel (11) to the proper position every time when the drawer (5) is taken in and out, it is possible to lighten the fastening force and the fixing force between the drawer and the door panel.

Further, in accordance with the present invention, because it is possible to receive the signal from the tablet case (6) by each of the circuit boards (17) arranged so as to be separated into each of the drawers (5), it is possible to structure the circuit which is independent per each of the drawers (5).

Further, in accordance with the present invention, because the door panel (11) is rotatably held by the mounting plate (18), it is possible to execute the fine adjustment of the door panel (11) on the basis of the operation of taking the drawer (5) in and out.

Further, in accordance with the present invention, since the door panel (11) is rotatably held by the spacer (24), it is possible to simplify the holding structure.

Further, in accordance with the present invention, since the thickness (T1) of the spacer (24) is larger than the thickness (T2) of the mounting plate (18), it is possible to absorb the excessive fastened distance by the difference in dimension even if there is generated the matter that the screw (23) is excessively fastened over the proper fastened position, and it is possible to inhibit and prevent the door panel (11) or the spacer (24) from being broken as a result of the fastening force.

Further, in accordance with the present invention, since the spacer (24) is made of metal, it is possible to inhibit and prevent the door panel (11) or the spacer (24) from being broken even if the screw (23) is excessively fastened over the proper fastened position.

Further, in accordance with the present invention, because the mounting plate (18) is constituted by the panel mounting body (21) fixing the door panel (11), and the substrate mounting body (22) fixing the circuit board (17), it is possible to get the leg of each of the fixing screws (23, 29) out by utilizing the gap formed between both of the mounting bodies (21, 22).

Further, in accordance with the present invention, because the panel mounting body (21) is provided with the cut-off hole (27) having the inner diameter (R2) which is smaller than the outer diameter (R1) of the head portion of the screw and larger than the outer diameter of the spacer, and the difference in dimension between the inner diameter (R2) of the cut-off hole and the outer diameter of the spacer is larger than the difference in dimension (T1-T2) between the thickness of the spacer and the thickness of the mounting plate, it is possible to rotatably hold the door panel (11) with respect to the drawer (5) by utilizing the difference in dimension.

Further, in accordance with the present invention, because the protruding portions (32, 33) for fine adjustment opposing to the adjacent door panel are provided in the outer periphery of the door panel (11), the protruding portions (32, 33) are respectively brought into contact with the adjacent surfaces of the adjacent door panels (11) every time the drawer (5) is taken in and out, whereby the rotatable door panel (11) is freely rotated, appropriately adjusts the gap of the vertically or laterally adjacent door panels to the fixed intervals (3*a*, 4*a*) automatically, and can execute the fine adjustment of the door panel (11).

Further, in accordance with the present invention, because the protruding portion (32) is formed at two right and left positions on the upper surface of the door panel (11), and is set to the proper dimension (3*a*) which is equal to the interval (3*a*) with respect to the vertically adjacent door panels, the protruding portion (32) is brought into contact with the adjacent surfaces of the vertically adjacent door panels (11) every time the drawer (5) is taken in and out, whereby the rotatable door panel (11) is freely rotated, and it is possible to automatically adjust the gap (3*a*) of both the door panels to the fixed interval (3*a*).

Further, in accordance with the present invention, because the protruding portion (33) is provided at the center of both the right and left sides of the door panel (11), and is set to the proper dimension (2*a*) which is equal to a half of the interval (4*a*) with respect to the laterally adjacent door panels, the protruding portion (33) is brought into contact with the adjacent surfaces of the laterally adjacent door panels (11) every time the drawer (5) is taken in and out, whereby the rotatable door panel (11) is freely rotated, and it is possible to automatically adjust the gap (4*a*) of both the door panels to the fixed interval (4*a*).

Further, in accordance with the present invention, because the door panel (11) attached to the panel mounting body (21), and the circuit board (17) attached to the substrate mounting body (22) are integrally rotated in accordance with the operation of taking the drawer (5) in and out, it is possible to always keep a proper positional relation between the substrate (17) and the panel (11).

Further, in accordance with the present invention, the medicine feeding apparatus is provided with the main body (2), a plurality of tablet cases (6) receiving the medicines, the drawers (5) attached to the main body so as to be freely drawn, and detachably attaching the tablet cases, and the drawer (5) is constituted by the drawer main body (15) detachably attaching a plurality of tablet cases, and the door panel (11) rotatably held to the front surface of the drawer main body, the circuit board (17) is arranged between the drawer main body and the door panel, the door panel (11) is rotatably held to the drawer main body (15) and is finely adjusted to the proper position in correspondence to the operation of taking the drawer (5) in and out, the medicine discharged from the tablet case (6) falls freely so as to be collected at one position, and the collected medicine is charged into the medicine packing paper. Accordingly, it is possible to execute the fine adjusting work of the door panel (11) to the proper position every time when the drawer (5) is taken in and out, and it is possible to lighten the fastening force and the fixing force between the drawer and the door panel.

Further, in accordance with the present invention, because the drawer (5) rotatably holds the door panel (11) to the front surface (16) of the drawer main (15) body via a mounting plate (18), and the mounting plate (18) is rotatably held to the drawer main body (15) by the screw (23) and the spacer (24), it is possible to receive the signal from the tablet case (6) by each of the circuit boards (17) arranged so as to be separated per the drawer (5), it is possible to construct the circuits which are independent per the drawers (5), and it is possible to execute the fine adjustment of the door panel (11) every time when the drawer (5) is taken in and out.

What is claimed is:

1. A medicine feeding apparatus comprising:

a main body:

drawers attached to said main body so as to be freely drawn;

a vertically-oriented door panel adjustably attached to a front surface of each of said drawers at a plurality of locations on the front surface via a mounting plate which is held adjacently to the front surface of each of said drawers; and a plurality of tablet cases detachably attached to said drawers for receiving medicines, wherein the relative position of each said door panel to the front surface of each said corresponding drawer is adjustable so as to properly position the door panel of each said drawer during an operation of taking the drawer in and out.

2. A medicine feeding apparatus as claims in claim 1, wherein said drawer is constituted by said front surface and a drawer main body detachably attaching a plurality of said tablet cases, and a said door panel is adjustably held to a front surface of said drawer main body, and a circuit substrate is arranged between the drawer main body and the door panel.

3. A medicine feeding apparatus as claimed in claim 2, wherein said mounting plate is adjustably held to the drawer main body by a screw and a spacer which both fit into a hole in said mounting plate.

4. A medicine feeding apparatus as claimed in claim 3, wherein a thickness of said spacer is larger than a thickness of said mounting plate.

5. A medicine feeding apparatus as claimed in claim 3, wherein said spacer is structured by a metal.

6. A medicine feeding apparatus as claimed in claim 2, wherein said mounting plate is constituted by a panel mounting body fixing said door panel, and a substrate mounting body fixing said circuit board.

7. A medicine feeding apparatus as claimed in claim 6, wherein the panel mounting body is provided with a cut-off hole having an inner diameter which is smaller than an outer diameter of a head portion of said screw and larger than an outer diameter of said spacer, and a difference in dimension between the inner diameter of said cut-off hole and the outer diameter of said spacer is larger than a difference in dimension between a thickness of said spacer and a thickness of said mounting plate.

8. A medicine feeding apparatus as claimed in claim 2, wherein an outer periphery of said door panel is provided with protruding portions for fine adjustment opposing to the adjacent door panel.

9. A medicine feeding apparatus as claimed in claim 8, wherein said protruding portion is formed at two right and left positions on an upper surface of the door panel, and has a proper height which is equal to an interval with respect to the upper and lower adjacent door panel.

10. A medicine feeding apparatus as claimed in claim 8, wherein said protruding portion is provided at the center of both right and left side surfaces of the door panel, and has a proper height which is equal to an interval with respect to the right and left adjacent door panel.

11. A medicine feeding apparatus as claimed in claim 6, wherein the door panel attached to said panel mounting body and the circuit board attached to said substrate mounting body are integrally moved in correspondence to the operation of taking said drawer in and out.

12. A medicine feeding apparatus comprising:

a main body;

a plurality of tablet cases receiving medicines; and drawers attached to said main body so as to be freely drawn, and detachably attaching said tablet cases, wherein said drawer is constituted by a drawer main body detachably attaching a plurality of tablet cases, and a vertically-oriented door panel adjustably held to a front surface of said drawer main body at a plurality of locations on the front surface, a circuit board is arranged between the drawer main body and the door panel, said door panel is adjustably held to the drawer main body and is finely adjusted to a proper position in correspondence to an operation of taking the drawer in and out by adjusting the relative positions of the door panel to the drawer, the medicine discharged from said tablet case falls freely so as to be collected at one position, and collected medicine is charged into a medicine packing paper, wherein said door panel is adjustably held to a front surface of said drawer main body via a mounting plate adjacently held against the front surface of the drawer main body by a screw and a spacer, both of which fit within a hole in said mounting plate.

* * * * *